US007293437B2

(12) United States Patent
Kim et al.

(10) Patent No.: US 7,293,437 B2
(45) Date of Patent: Nov. 13, 2007

(54) GASKET AND WASHING MACHINE USING THE SAME

(75) Inventors: Jae Kyum Kim, Gimhae-si (KR); Ho Cheol Kwon, Changwon-si (KR); Kang Mo Choi, Masan-si (KR)

(73) Assignee: LG Electronics Inc., Seoul (KR)

( * ) Notice: Subject to any disclaimer, the term of this patent is extended or adjusted under 35 U.S.C. 154(b) by 592 days.

(21) Appl. No.: 10/722,443

(22) Filed: Nov. 28, 2003

(65) Prior Publication Data

US 2004/0107742 A1 Jun. 10, 2004

(30) Foreign Application Priority Data

Nov. 29, 2002 (KR) ..... 10-2002-0075311

(51) Int. Cl.

| | |
|---|---|
| ***B08B 3/12*** | (2006.01) |
| ***D06F 37/00*** | (2006.01) |
| ***D06F 29/00*** | (2006.01) |
| ***D06F 35/00*** | (2006.01) |
| ***D06F 15/00*** | (2006.01) |
| *E21B 33/12* | (2006.01) |

(52) U.S. Cl. ..... 68/23 A; 68/5 E; 68/23 A; 68/24; 68/36; 166/115; 166/116

(58) Field of Classification Search ..... 68/5 E, 68/24, 23 A, 36

See application file for complete search history.

(56) References Cited

U.S. PATENT DOCUMENTS

| | | | | |
|---|---|---|---|---|
| 2,613,837 | A * | 10/1952 | Morton | 206/320 |
| 6,256,823 | B1 * | 7/2001 | Kronbetter et al. | 8/158 |
| 2004/0025544 | A1 * | 2/2004 | Kim et al. | 68/3 R |

* cited by examiner

*Primary Examiner*—M. Kornakov
*Assistant Examiner*—Rita R Patel
(74) *Attorney, Agent, or Firm*—Birch, Stewart, Kolasch & Birch, LLP

(57) ABSTRACT

A drum washing machine having a gasket to prevent leakage of water in the tub and the laundry from being stuck in a laundry opening part. The washing machine including a cabinet having a first opening through which a laundry is put in the cabinet, a tub installed in the cabinet to have a second opening corresponding to the first opening, a drum installed in the tub to have a third opening corresponding to the second opening, and a gasket including a leakage preventing part having one end connected to a rim of the first opening and the other end connected to a rim of the second opening to prevent water leakage and a laundry-stuck preventing part provided on an inner circumference of the leakage preventing part to prevent the laundry from being stuck in a space between the first and third openings.

10 Claims, 5 Drawing Sheets

GASKET AND WASHING MACHINE USING THE SAME

This application claims the benefit of Korean Application(s) No. 10-2002-0075311 filed on Nov. 29, 2002, which is/are hereby incorporated by reference.

BACKGROUND OF THE INVENTION

1. Field of the Invention

The present invention relates to a washing machine, and more particularly, to a gasket and drum type washing machine using the same, which prevents a laundry from being stuck in a laundry opening part.

2. Discussion of the Related Art

Generally, a washing machine holds water and detergent in a lower part of a tub. After laundry is put in a drum installed inside the tub, the drum is rotated to perform washing, rinsing, and dewatering.

Such a washing machine is an apparatus for eliminating dirt or filth attached to the laundry by applying a mechanical force thereto together with a detergent.

Specifically, a drum type washing machine is an apparatus for eliminating dirt or filth attached to the laundry by putting the laundry, water, and detergent in a drum horizontally installed to rotate by a driving force of a motor. The drum type washing machine barely has entanglement and damage of the laundry, consumes less water, and even has washing effects of beating and rubbing.

Referring to FIG. 1 and FIG. 2, a general drum type washing machine consists of a cabinet 10 forming an exterior to have a first opening 11 at a front side to put in/out a laundry, a door 12 installed in front of the cabinet 10 to open/close the first opening 11, a tub 20 provided inside the cabinet 10 to have a second opening 21 communicating with the first opening 11, and a drum 50 rotatably installed inside the tub 20 to have a third opening 50*a* communicating with the first opening 11.

In this case, the first to third openings construct an opening part through which the laundry is put in.

The drum 50 includes lifters 25 on its inside to pull the laundry up to a predetermined height. Once the drum rotates, the laundry is lifted up to an upper part of the drum by the lifters and then falls down for washing.

A rotational means for rotating the drum is provided in a space between an inside of the cabinet and the tub 20.

The rotational means consists of a motor 40 provided under the tub to be electrically driven, a first rotational shaft 41 extending in a rear direction of the cabinet to have one end connected to the motor 40, a driving pulley 42 provided at the other end of the first rotational shaft 41, a second rotational shaft 43 having one end connected to a rear side of the drum, a driven pulley 44 provided at the other end of the second rotational shaft 43, and a belt 45 connecting the driving and driven pulleys 42 and 44.

A rotational force of the motor enabling forward and reverse rotations is transferred to the drum via the two rotational shafts, driving pulley, belt, and driven pulley.

Meanwhile, a water supply hose 16, a water supply valve (not shown in the drawing), and a detergent box 17 for supplying water and detergent to the tub 20 are installed in an upper side of the cabinet 10. And, a drain pump 18 and a drain hose 19 for circulating or draining the water are installed under the tub 20.

A control panel 15 provided as a control means for controlling an operation of the drum type washing machine is installed on an upper front side of the cabinet 10.

Moreover, a gasket 50 is provided between the first and second openings 11 and 21 to buffer shocks generated from forward and reverse vibrations of the drum and to prevent leakage of the water when the drum is rotating with the door closed.

Referring to FIG. 3, the gasket 50 consists of a front end coupling part 51 enclosing the first opening 11 to be coupled with the first opening, a rear end coupling part 52 enclosing the second opening 21 to be coupled with the second opening 21, and a middle connecting part 53 of a flexible material connecting the front and rear end coupling parts 51 and 52.

The middle connecting part 53 consists of a first connecting member 53*a* having one end connected to the front end coupling part 51 to horizontally extend toward the tub, a second connecting member 53*b* having one end connected to the other end of the first connecting member 53*a* to radially extend toward the front side of the cabinet, and a third connecting member 53*c* having one end connected to the other end of the second connecting member 53*b* and having the other end connected to the rear end coupling part 52.

Thus, the middle connecting part 53 is bent to prevent shocks from appearing on the cabinet due to vibrations of the drum and tub when the washing machine is operating.

And, the middle connecting part 53 further consists of a ring type protrusion 54 protruding from its inside to block a predetermined portion of a gap between the second and third openings 21 and 50*a*.

However, in the general drum type washing machine having the above-constructed gasket, while the washing machine operates, the laundry is stuck between the bent middle connecting part and the ring type protrusion, whereby damages are caused to the laundry and the gasket to shorten the endurance of the washing machine as well as the motor is overloaded to cause noise and vibration.

To overcome such a problem, a new drum type washing machine equipped with a means for preventing the laundry from being stuck in the space between the first and third openings is needed.

SUMMARY OF THE INVENTION

Accordingly, the present invention is directed to a gasket and drum type washing machine using the same that substantially obviates one or more of the problems due to limitations and disadvantages of the related art.

An object of the present invention, which has been devised to solve the foregoing problem, lies in providing a gasket and drum type washing machine using the same, by which the laundry is prevented from being stuck in a laundry opening part between a cabinet and a drum.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided, in a washing machine including a cabinet having a first opening through which a laundry is put in, a tub having a second opening at a tub front side, and a drum rotatably installed in the tub to have a third opening at a drum front side, a gasket according to the present invention includes a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet and a laundry-stuck preventing part provided on an inner circumference of the leakage preventing part to prevent the laundry from being stuck in a space between the first and third openings.

The leakage preventing part includes a first connecting member having one end connected to the first opening to horizontally extend toward the tub, a second connecting member having one end connected to the other end of the first connecting member to radially extend toward the front side of the cabinet, and a third connecting member having one end connected to the other end of the second connecting member and having the other end connected to the second opening.

The laundry-stuck preventing part includes a ring type protrusion protruding from an inner circumference of the third connecting member toward the third opening to prevent the laundry from being stuck between the drum and the respective first to third openings and a laundry discharge part provided on an upper inner circumference of the ring type protrusion to discharge the laundry stuck between the leakage preventing part and the ring type protrusion when the drum is rotating.

The laundry discharge part comprises a discharge protrusion extending downward form an upper end of the inner circumference of the ring type protrusion.

In front view, a lower end of the discharge protrusion is tapered.

The laundry discharge part is provided on an upper hemi-circle of the inner circumference of the ring type protrusion and may have a shape of which width increases gradually toward a top of the hemi-circle.

In another aspect of the present invention, there is provided a drum type washing machine includes a cabinet having a first opening through which a laundry is put in at a cabinet front side wherein a door is installed to open/close the first opening, a tub installed in the cabinet to have a second opening at a tub front side corresponding to the first opening, a drum installed in the tub to have a third opening at a drum front side corresponding to the second opening, a rotation mans having a rotational shaft penetrating a rear side of the tub to be connected to the drum, and a gasket for preventing leakage of water in the tub, shocks by vibrations of the tub and drum from appearing on the cabinet, and the laundry from being stuck in a space between the first and third openings.

And, the gasket includes a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet and a laundry-stuck preventing part provided on an inner circumference of the leakage preventing part to prevent the laundry from being stuck in a space between the first and third openings.

Therefore, the above-constructed drum type washing machine according to the present invention enables to prevent water leakage from taking place in operating the washing machine and to prevent the laundry from being stuck in the laundry opening part between the cabinet and the drum.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
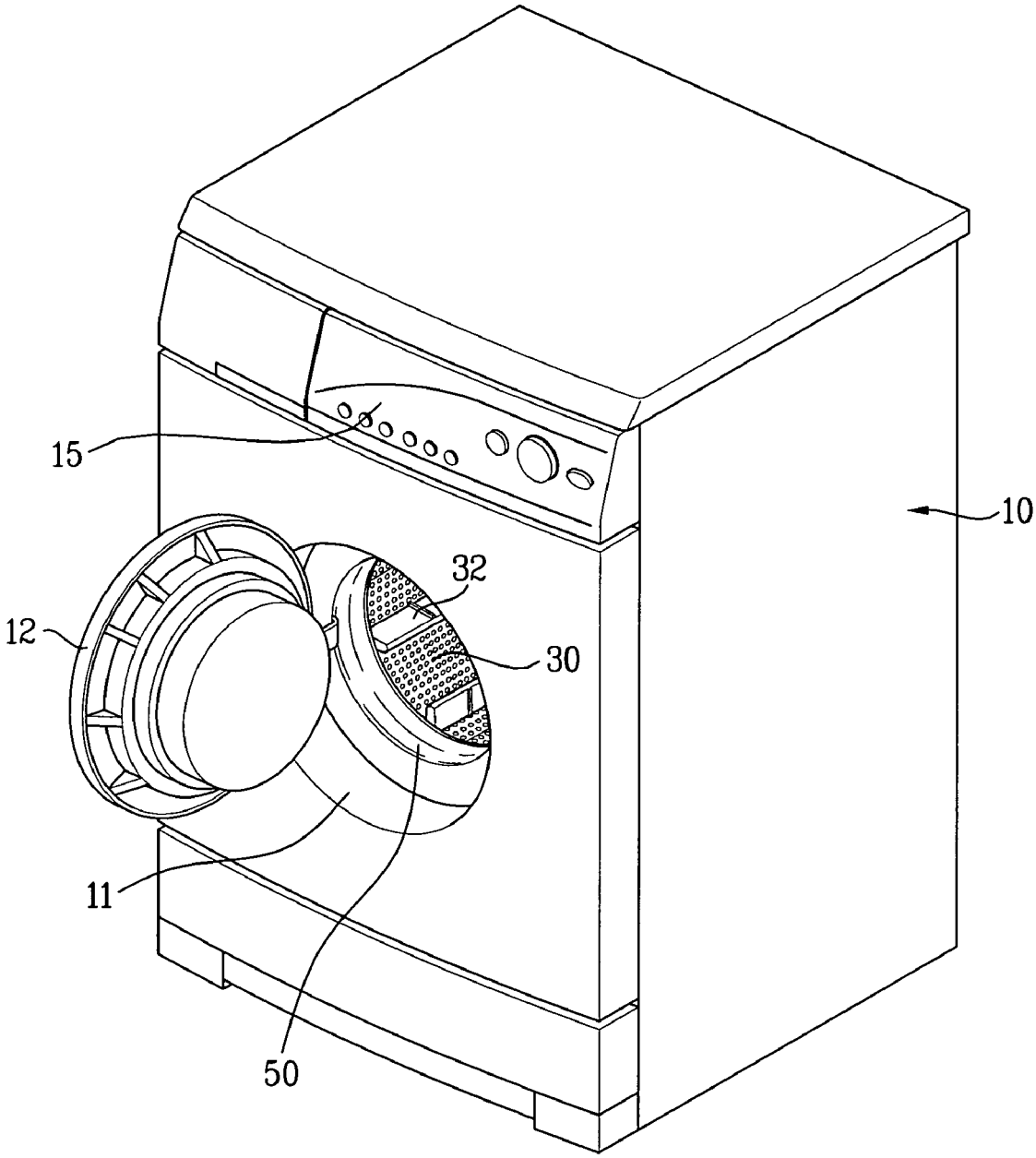
FIG. 1 is a perspective view of a general drum type washing machine.
Figure 2:
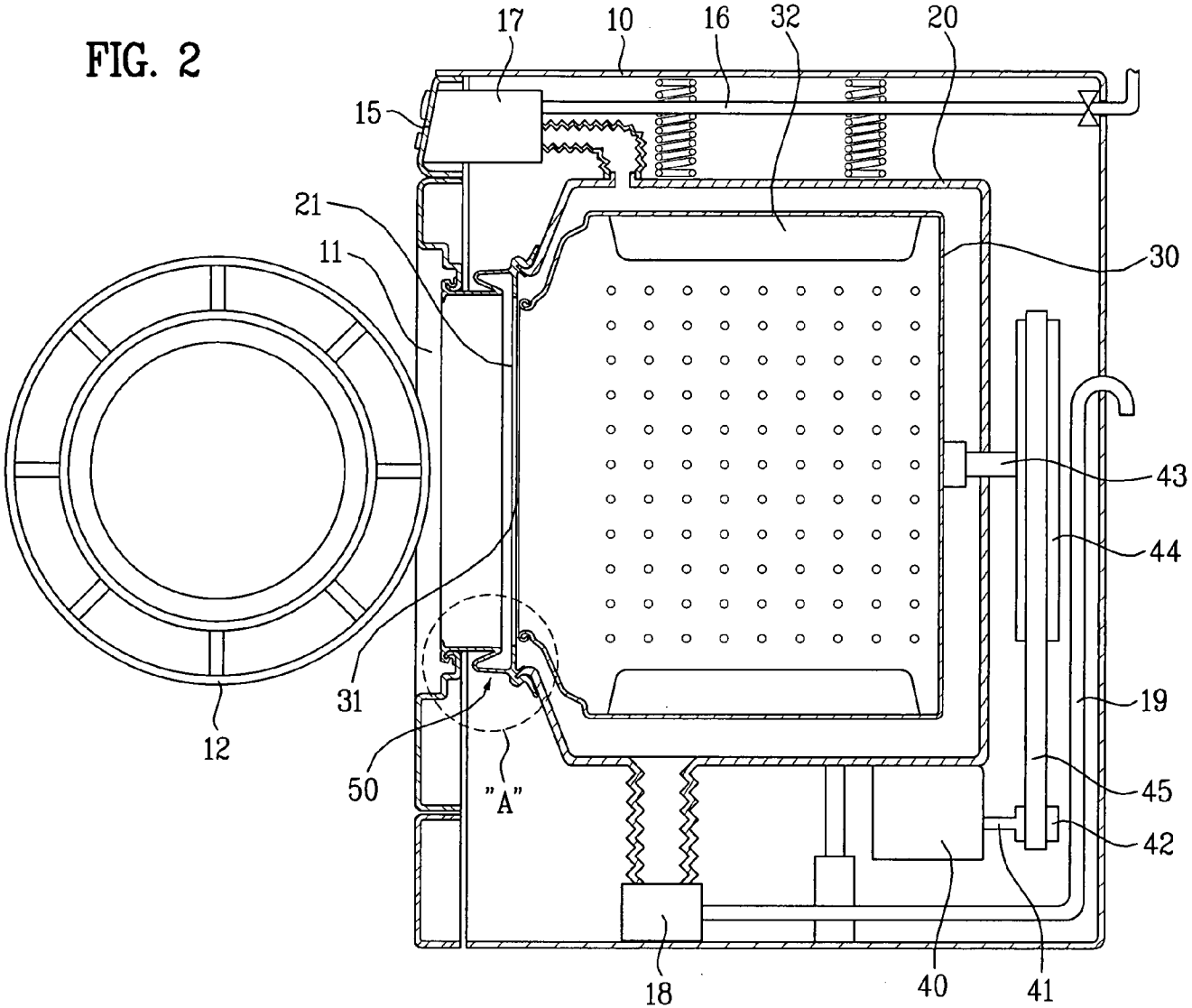
FIG. 2 is a schematic internal view of a general drum type washing machine.
Figure 3:
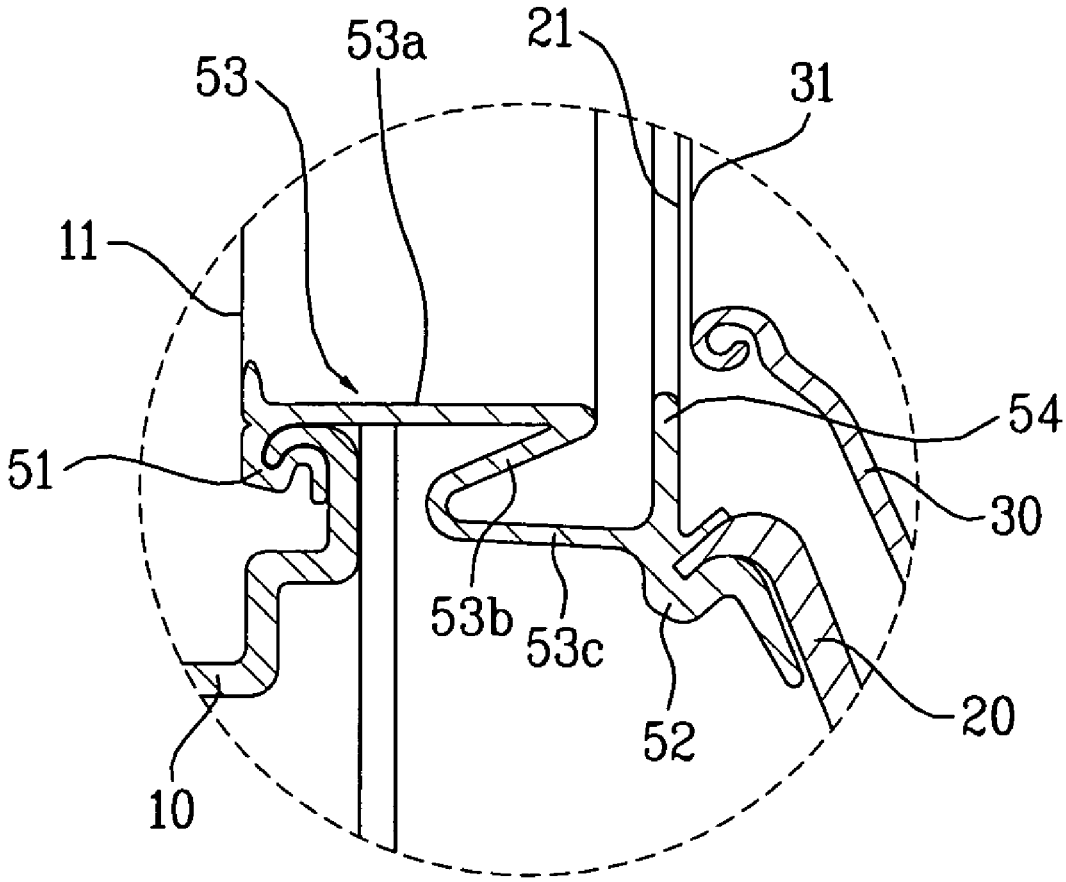
FIG. 3 is a magnified view of 'A' in FIG. 2.
Figure 4:
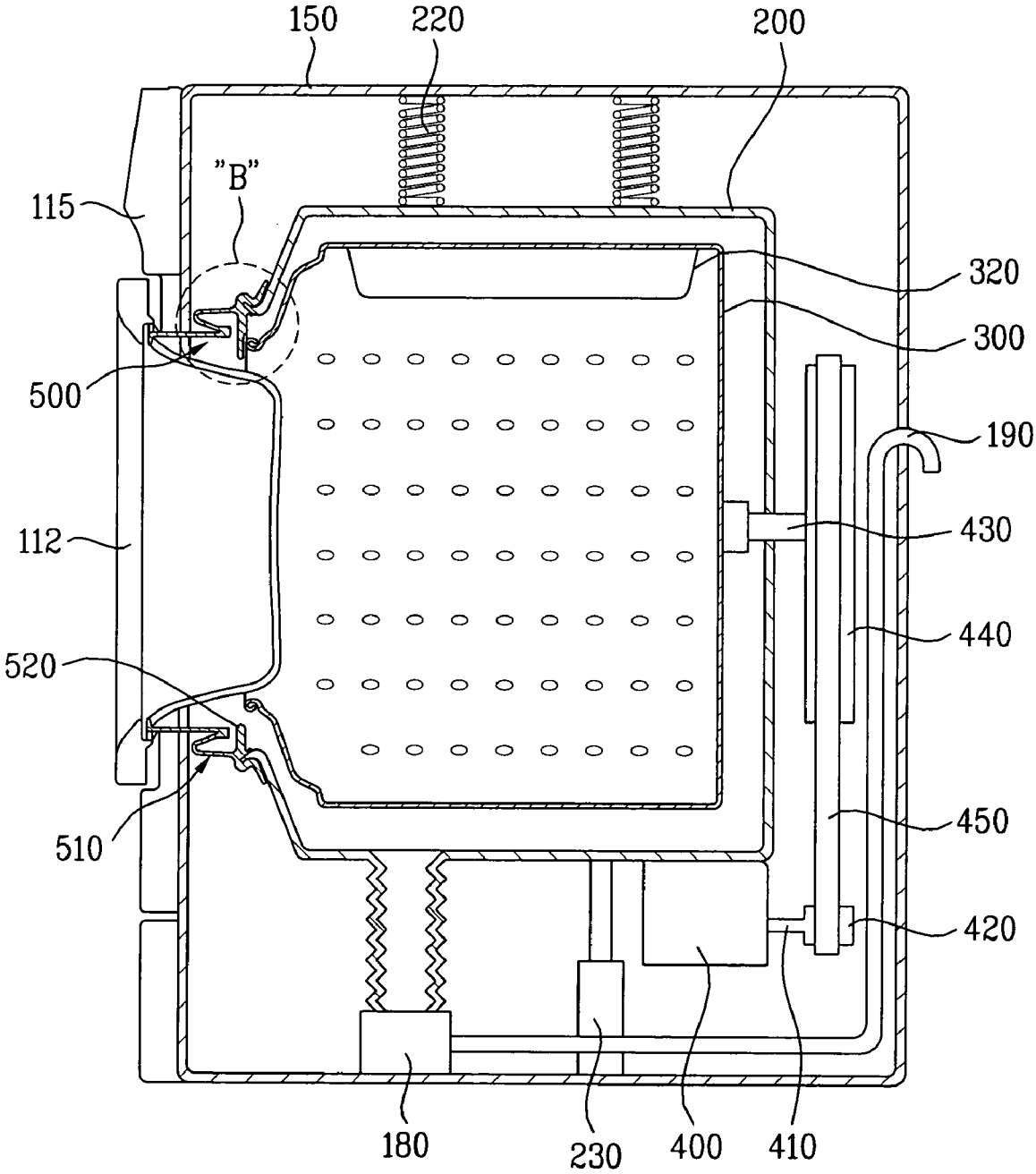
FIG. 4 is a schematic internal view of a drum type washing machine according to the present invention.
Figure 5:
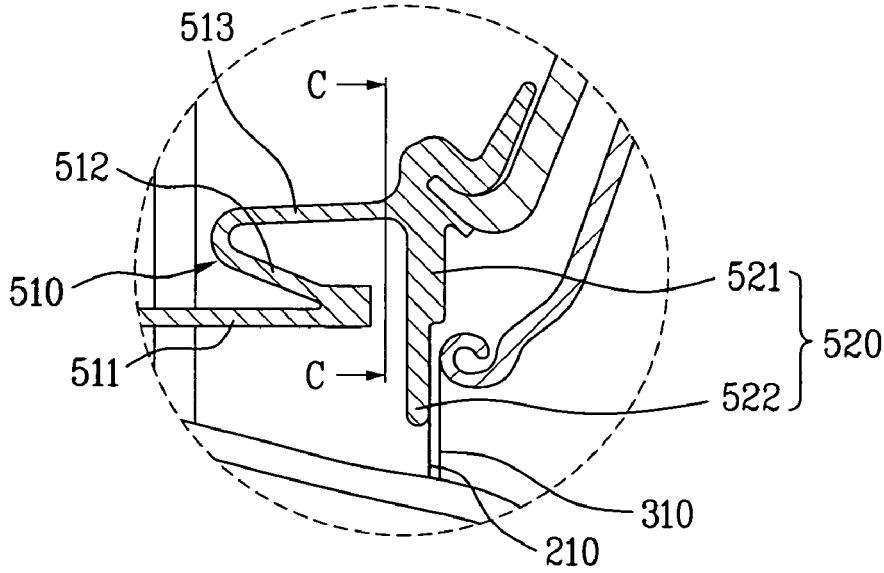
FIG. 5 is a magnified view of 'B' in FIG. 4.
Figure 6:
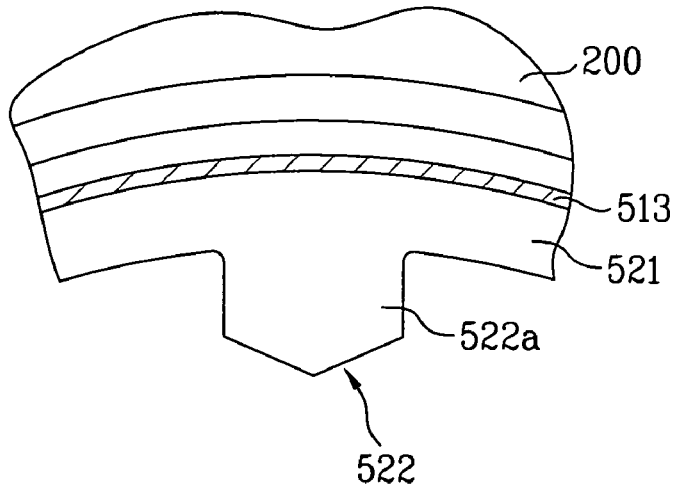
FIG. 6 is a cross-sectional view of 'B' bisected along a line C-C in FIG. 5.

FIG. 4 is a schematic internal view of a drum type washing machine according to the present invention, FIG. 5 is a magnified view of 'B' in FIG. 4, and FIG. 6 is a cross-sectional view of 'B' bisected along a line C-C in FIG. 5.

Referring to FIG. 4 and FIG. 5, a drum type washing machine according to one preferred embodiment of the present invention includes a cabinet 100 forming an exterior, a tub 200 provided in the cabinet, a drum 300 rotatably provided in the tub 200, and a rotation means for rotating the drum.

The cabinet includes a base plate 120 installed at a bottom, a pair of side plates provided on both sides of the bas plate 120, a rear plate 140 provided in rear of the side plates, a front plate 110 provided in front of the base and side plates, and a top plate 150 provided on the side, rear, and front plates.

A first opening 111 through which a laundry is put in/out is formed at a center of the front plate 110. And, a door 112 is installed at the front plate 110 to open/close the first opening 111 and to prevent the laundry from being thrown away through the first opening 111.

A control panel 115 controlling an operation of the drum type washing machine is installed on an upper front side of the top plate 150.

A second opening 210 is formed at a front side of the tub 200 to correspond to the first opening 111 of the front plate 110 and to communicate with the first opening 111.

And, an elastic means 220 and a damper 230 are formed over and under the tub 200, respectively to attenuate a vibration generated from an operation of the washing machine.

A gasket 500 is installed between the door 112 and the tub 200 to alleviate a shock generated from rotation of the drum 300 and to play a role of a packing for preventing water from leaking outside.

The drum 300 includes lifters 320 on its inside to pull up the laundry to a predetermined height and a third opening 310 at its front side to correspond to the second opening 210.

Once the drum 300 rotates, the laundry is firstly lifted up to an upper part of the drum by the lifters 320 and then falls downward to perform washing.

And, the third opening 310 is provided as an entrance through which the laundry having put in via the first and second openings 111 and 210 finally enters the drum 300.

The above-described first to third openings construct an opening part through which the laundry is put in the drum from the front side of the cabinet.

The rotational means consists of a motor 400 provided under the tub to be electrically driven, a first rotational shaft 410 extending in a rear direction of the cabinet to have one end connected to the motor 400, a driving pulley 420 provided at the other end of the first rotational shaft 410, a second rotational shaft 430 having one end connected to a rear side of the drum, a driven pulley 440 provided at the other end of the second rotational shaft 430, and a belt 450 connecting the driving and driven pulleys 420 and 440.

A rotational force of the motor enabling forward and reverse rotations is transferred to the drum via the two rotational shafts, driving pulley, belt, and driven pulley.

Meanwhile, a drain pump 180 and a drain hose 190 for circulating or draining the water are installed at one inner side of the cabinet 100 under the tub 200.

The gasket 500 according to one embodiment of the present invention is explained in detail by referring to FIG. 5 and FIG. 6 as follows.

In the embodiment according to the present invention, an inside diameter of the second opening 210 is formed greater than that of the third opening 310.

Moreover, the second opening 210 is formed ahead of the third opening 310.

The gasket 500 prevents shock caused by the vibrations of the tub and drum from appearing on the front side of the cabinet, blocks a gap between the first and second openings 111 and 210 to prevent leakage of the water, and prevents the laundry from being stuck in a space between the first and third openings 210 and 310.

Specifically, the gasket 500 includes a leakage preventing part 510 having one end connected to a rim of the first opening and the other end connected to a rim of the second opening wherein a part between the one and the other ends is bent to prevent the shocks by the tub and drum and a laundry-stuck preventing part 520 provided on an inner circumference of the leakage preventing part 510 to prevent the laundry from being stuck in the space between the first and third openings.

The leakage preventing part 510 includes one end enclosing a rim of the first opening 111 and the other end enclosing a rim of the second opening 210.

Specifically, the leakage preventing part 510 is formed of a flexible material, and includes a first connecting member 511 having one end enclosing to be connected to the rim of the first opening to horizontally extend toward the tub, a second connecting member 512 having one end connected to the other end of the first connecting member 511 to radially extend toward the front side of the cabinet, and a third connecting member 513 having one end connected to the other end of the second connecting member 512 and having the other end enclosing to be connected to the second opening.

Thus, the leakage preventing part 510 is bent to prevent shocks from appearing on the cabinet due to vibrations of the drum and tub when the washing machine is operating.

The laundry-stuck preventing part 520 includes a ring type protrusion 521 protruding from an inner circumference of the third connecting member toward the third opening to prevent the laundry from being stuck between the drum and the respective openings 111, 210, and 310 and a laundry discharge part 522 provided on an upper inner circumference of the ring type protrusion 521 to discharge the laundry stuck between the leakage preventing part 510 and the ring type protrusion 521 when the drum is rotating.

The laundry discharge part 522 includes a discharge protrusion 522*a* extending downward form an upper end of the inner circumference of the ring type protrusion 52.

In front view, a lower end of the discharge protrusion 522*a* is tapered.

Yet, the laundry discharge part 522 is provided on an upper hemi-circle of the inner circumference of the ring type protrusion 521 and may have a shape (not shown in the drawing) of which width increases gradually toward a top of the hemi-circle.

An operation of the above-constructed drum type washing machine according to the present invention is explained as follows.

First of all, a user opens the door 112, puts an appropriate amount of laundry in the drum 300 via the first opening 111, closes the door 112, puts water and detergent, selects an appropriate washing course, and then initiates an operation of a washing step.

In this case, the laundry having been put in the drum 300 is repeatedly lifted up and falls down so that the washing is performed.

After completion of the washing step, a dewatering step is executed. The dewatering step is performed in a manner that the drum 300 rotates a high speed to separate water contents from the laundry by a centrifugal force.

Meanwhile, the laundry may be discharged through the third opening 310 of the drum 300 in part while the washing or dewatering is in progress. The discharged-in-part laundry is then stuck between the leakage preventing part 510 having the bent shape and the ring type protrusion 521 to rotate together with the drum 300.

The laundry, which is stuck between the leakage preventing part 510 of the bent shape and the ring type protrusion 521, is then caught on the discharge protrusion 522*a* to escape from the gap as rotationally being moved toward an upper side of the inner circumference of the gasket having the discharge protrusion 522*a* by the drum 300.

Thus, the escaping laundry is guided by the lower end of the discharge protrusion 522*a* to come back inside the drum 300.

Accordingly, the present invention has the following advantages or effects.

First of all, the present invention prevents the laundry from being stuck in the laundry opening part, thereby enabling to prevent the damage of the laundry.

Secondly, the laundry stuck in the gap between the leakage preventing part and ring type protrusion of the gasket can be immediately discharged from the gap, whereby the gasket is prevented from being damaged.

Thirdly, the present invention prevents the laundry from being stuck, thereby reducing noise and vibration of the washing machine, and prevents overload of the driven motor to prolong the endurance of the washing machine.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a washing machine including a cabinet having a first opening through which laundry is put in at a cabinet front side, a tub having a second opening at a tub front side, and a drum rotatably installed in the tub to have a third opening at a drum front side, a gasket comprising:

a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet; and a laundry-stuck preventing part extended inwardly in a radial direction from an inner circumference of the leakage preventing part, and configured to prevent the laundry from being stuck in a space between the first and third openings, wherein the laundry-stuck preventing part is provided around the entire inner circumference of the leakage preventing part, the laundry-stuck preventing part including:

a ring protrusion protruding from the inner circumference of the gasket toward the third opening; and a laundry discharge part provided on an upper hemicircle of an inner circumference of the ring protrusion to discharge the laundry stuck between the leakage preventing part and the ring protrusion when the drum is rotating, the laundry discharge part extending generally in the same direction as the ring protrusion, and has a shaped of which a width increases gradually toward a top part of the hemicircle.

2. The gasket as claimed in claim 1, the leakage preventing part comprising:

a first connecting member having one end connected to the first opening to horizontally extend toward the tub;

a second connecting member having one end connected to the other end of the first connecting member to radially extend toward the cabinet front side; and a third connecting member having one end connected to the other end of the second connecting member and having the other end connected to the second opening.

3. The gasket as claimed in claim 2, wherein the ring protrusion protrudes from an inner circumference of the third connecting member toward the third opening.

4. The gasket as claimed in claim 3, wherein the laundry discharge part comprises a discharge protrusion extending downward from an upper end of the inner circumference of the ring protrusion.

5. The gasket as claimed in claim 4, wherein, in front view, a lower end of the discharge protrusion is tapered.

6. A drum washing machine comprising:

a cabinet having a first opening through which laundry is put in at a cabinet front side wherein a door is installed to open/close the first opening;

a tub installed in the cabinet to have a second opening at a tub front side corresponding to the first opening;

a drum installed in the tub to have a third opening at a drum front side corresponding to the second opening;

a rotation means having a rotational shaft penetrating a rear side of the tub to be connected to the drum; and a gasket for preventing leakage of water in the tub, shocks by vibrations of the tub and drum from appearing on the cabinet, and the laundry from being stuck in a space between the first and third openings, the gasket including:

a leakage preventing part having one end connected to a rim of the first opening and the other end connected to a rim of the second opening to prevent water leakage wherein a portion between the one and the other ends of the leakage preventing part is bent to prevent shocks by vibration of the tub and drum from appearing on the cabinet; and a laundry-stuck preventing part extended inwardly in a radial direction from an inner circumference of the leakage preventing part and configured to prevent the laundry from being stuck in a space between the first and third openings, wherein the laundry-stuck preventing part is provided around the entire inner circumference of the leakage preventing part, the laundry-stuck preventing part having:

a ring protrusion protruding from the inner circumference of the gasket toward the third opening; and a laundry discharge part provided on an upper hemicircle of an inner circumference of the ring protrusion to discharge the laundry stuck between the leakage preventing part and the ring protrusion when the drum is rotating, the laundry discharge part extending generally in the same direction as the ring protrusion, and has a shaped of which a width increases gradually toward a top part of the hemi-circle.

7. The drum washing machine as claimed in claim 6, the leakage preventing part comprising:

a first connecting member having one end connected to the first opening to horizontally extend toward the tub;

a second connecting member having one end connected to the other end of the first connecting member to radially extend toward the front side of the cabinet; and a third connecting member having one end connected to the other end of the second connecting member and having the other end connected to the second opening.

8. The drum washing machine as claimed in claim 7, wherein the ring protrusion protrudes from an inner circumference of the third connecting member toward the third opening.

9. The drum washing machine as claimed in claim 8, wherein the laundry discharge part comprises a discharge protrusion extending downward from an upper end of the inner circumference of the ring protrusion.

10. The drum washing machine as claimed in claim 9, wherein, in front view, a lower end of the discharge protrusion is tapered.

* * * * *